US005393198A

United States Patent [19]

Noda et al.

[11] Patent Number: 5,393,198

[45] Date of Patent: Feb. 28, 1995

[54] GAS TURBINE AND GAS TURBINE BLADE

[75] Inventors: Masami Noda; Takashi Ikeguchi; Shunichi Anzai, all of Hitachi; Kazuhiko Kawaike, Katsuta; Isao Takehara, Hitachi, all of Japan

[73] Assignee: Hitachi, Ltd., Tokyo, Japan

[21] Appl. No.: 120,474

[22] Filed: Sep. 14, 1993

[30] Foreign Application Priority Data

Sep. 18, 1992 [JP] Japan ..... 4-249933

[51] Int. Cl.[6] ..... F01D 5/18; F01D 9/02

[52] U.S. Cl. ..... 415/115; 416/97 R; 416/223 A

[58] Field of Search ..... 415/115, 116, 191; 416/96 R, 97 R, 223 A

[56] References Cited

U.S. PATENT DOCUMENTS

| | | | |
|---|---|---|---|
| 1,777,098 | 9/1930 | Lysholm | 416/223 A |
| 2,830,753 | 4/1958 | Stalker | 416/223 A |
| 2,866,618 | 12/1958 | Jackson | 415/96 R |
| 3,623,318 | 11/1971 | Shank | 415/115 |
| 4,229,140 | 10/1980 | Scott | 415/115 |
| 4,396,349 | 8/1983 | Hueber | 415/115 |
| 4,484,859 | 11/1984 | Pask et al. | 415/115 |
| 4,962,640 | 10/1990 | Tobery | 415/115 |

FOREIGN PATENT DOCUMENTS

| | | | |
|---|---|---|---|
| 466501 | 1/1992 | European Pat. Off. . | |
| 108822 | 4/1990 | Japan | 416/97 R |
| 2-241902 | 9/1990 | Japan . | |

OTHER PUBLICATIONS

Nagai, Mori, Hiura, Sato & Fukue, (Mitsubishi), "Development of 10 MW Class Small Scale High Temperature Gas Turbine", Thermal or Nuclear Power Generation, vol. 38, No. 9, pp. 889, Fig. 15.

Transactions of the ASME Journal of Engineering for Power, Jan., 1981, vol. 103, "Boundary Layer Studies on Highly Loaded Cascades Using Heated Thin Films and a Traversing Probe", pp. 237–246.

*Primary Examiner*—Edward K. Look
*Assistant Examiner*—James A. Larson
*Attorney, Agent, or Firm*—Fay, Sharpe, Beall, Fagan, Minnich & McKee

[57] ABSTRACT

A blade for a gas turbine has a leading edge portion which has an arc-shaped cross-section, and a maximum thickness portion of the blade is located within this arc. With this blade configuration, an abrupt acceleration of hot gas at the leading edge portion of the blade is restrained, so that the velocity of the hot gas at the blade surface can be made low. Therefore, the heat transfer coefficient from the hot gas to the blade wall is lowered, so that the amount of cooling air required to be passed through the interior of the blade can be reduced.

9 Claims, 5 Drawing Sheets

GAS TURBINE AND GAS TURBINE BLADE

BACKGROUND OF THE INVENTION

This invention relates to a gas turbine having blades each being designed to be cooled from the inside by a cooling medium, and also relates to improvement in such a blade.

Recently, in order to enhance the performance of a gas turbine engine, the temperature of the combustion gas has been raised higher, so that blades of the gas turbine operate in a very thermally severe environment.

Therefore, these blades should be sufficiently cooled by some cooling means.

Generally, for cooling a turbine blade of this type, there has been extensively used a method in which part of the compressed air used for combustion purposes is caused to flow through a cavity portion within the blade. A typical example of such a blade cooling method is disclosed, for example, in Japanese Patent Unexamined Publication No. 2-241902.

With respect to the shape or profile of a blade of this type, a camber line constituting a central factor in the blade profile shape is defined by a circular arc, part of a parabola, or part of another smoothly-changing curve, and the blade profile is determined or designed along this camber line. In this case, the thickness of the blade first increases progressively from a leading edge thereof toward a trailing edge thereof to reach a maximum value, and then decreases progressively to the trailing edge.

The gas turbine blade thus formed is cooled from its inside, as described above. In the case of the gas turbine, the air used for this cooling operation is usually provided by a part of the combustion air. Therefore, when the amount of consumption of the cooling air is large, the combustion air is limited, which affects the operation cycle of the gas turbine to be operated under the high temperature. Therefore, it is desirable that the amount of the cooling air used for cooling the blades be minimized.

SUMMARY OF THE INVENTION

With the above problems of the prior art in view, it is an object of this invention to provide a gas turbine blade which can be efficiently cooled with a smaller amount of cooling air.

Another object of the invention is to provide a gas turbine with such blades which can operate at sufficiently high temperatures.

In the present invention, a thickness of a blade for a gas turbine decreases progressively from its leading edge portion toward its trailing edge portion, and a cooling medium passageway is formed within the blade. The leading edge portion of the blade has an arc-shaped cross-section, and a maximum thickness portion of the blade is located within this arc.

With this blade configuration, main stream gas flows along an endpoint portion of the arc, which portion is smoothly connected to a pressure side of the blade, and also along an endpoint portion of the arc which is smoothly connected to a suction side of the blade, and therefore an abrupt acceleration of the hot gas at the leading edge portion is suppressed to reduce the velocity of the hot gas on the blade surface. As a result, the heat transfer coefficient on the gas side is lowered, and therefore the amount of the cooling air required to be passed through the interior of the blade can be reduced.

DESCRIPTION OF THE PREFERRED EMBODIMENTS

Preferred embodiments of the present invention will now be described in detail with reference to the drawings.

Figure 3:
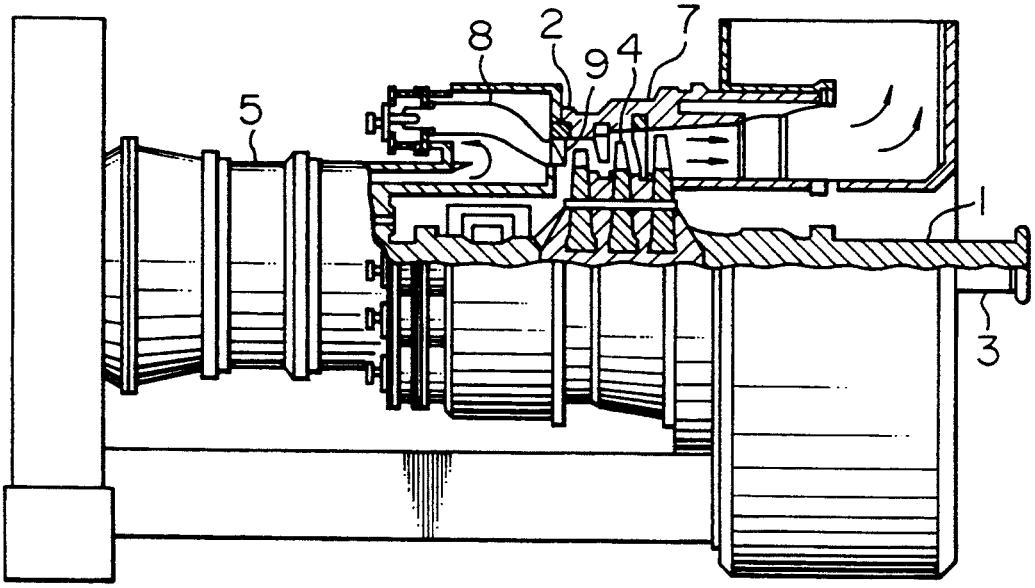
FIG. 3 is a partly-broken, side-elevational view of a gas turbine incorporating stationary blades of the present invention.

FIG. 3 is a partly cross-sectional view showing a gas turbine comprising a rotor 1 and a stator 2. The rotor 1 broadly comprises a rotation shaft 3, moving blades or rotor blades 4 mounted on the rotation shaft 3, and moving blades of a compressor 5 mounted on the rotation shaft 3. The stator 2 broadly comprises a casing 7, a combustor 8 supported by the casing 7 in opposed relation to the rotor blades 4, and stator blades 9 serving as a nozzle of the combustor.

The operation of the gas turbine of this construction will now be described briefly. First, compressed air from the compressor 5 and fuel are supplied to the combustor 8, and the fuel is burned in the combustor 8 to produce hot or high-temperature gas. The thus produced hot gas is blown to the rotor blades 4 through the stator blades 9 to drive the rotor 1 through the rotor blades 4.

In this case, the rotor blades 4 and the stator blades 9 exposed to the hot gas need to be cooled, and part of the compressed air produced by the compressor 5 is used as a cooling medium for cooling the blades.

Figure 4:
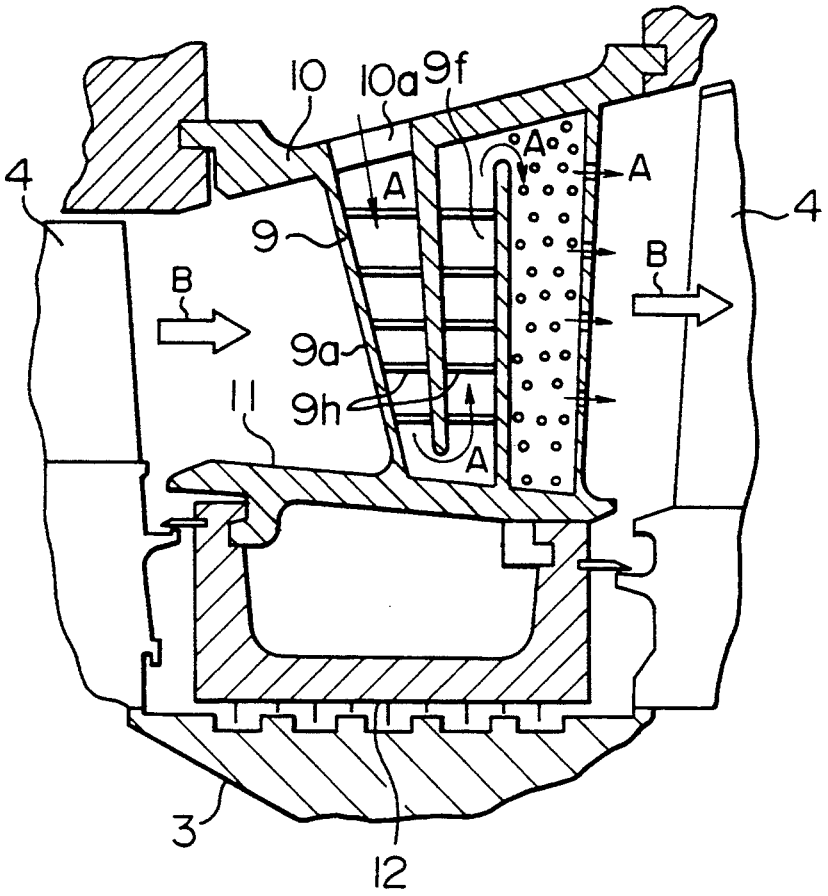
FIG. 4 is a sectional view of the stationary blades of the present invention.

FIG. 4 shows an example of cooling of the stator blade. This Figure shows a portion where the stator blade 9 and the rotor blades 4 are provided.

The stator blade 9 is interposed between and fixedly secured to an outer peripheral wall 10 and an inner peripheral wall 11. A labyrinth seal 12 is provided, on the inner peripheral wall 11, in a gap between the inner peripheral wall 11 and the rotation shaft 3 to separate an upstream side from a downstream side. The cooling air from a cooling air source, that is, the compressor 5 (see FIG. 3), is introduced into an air cooling chamber 9*f* within the stator blade 9 through a cooling air introduction port 10*a* formed in the outer peripheral wall 10.

The cooling air, after cooling the stationary blade 9, is discharged to a gas passageway.

In FIG. 4, arrows A indicate a flow of the cooling air, and thick arrows B indicate a flow of the hot gas (i.e., the main stream operating gas).

Figure 1:
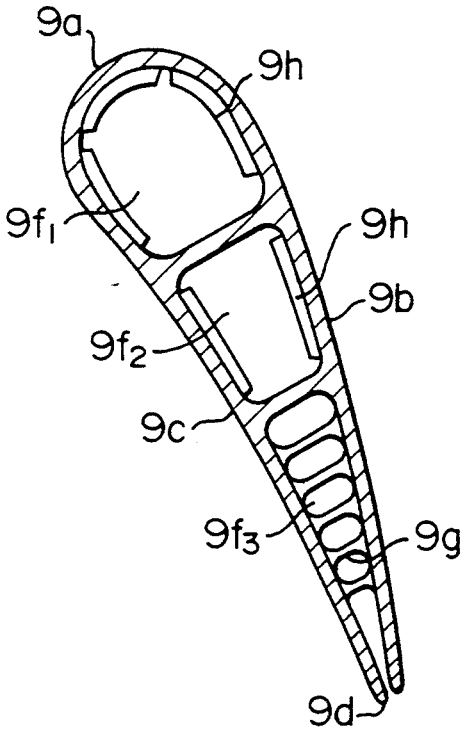
FIG. 1 is a cross-sectional view of a preferred embodiment of a stationary blade of the present invention.

Thus, the stator blade 9 is cooled from its inside, and particularly this stator blade is formed into the following shape or profile. FIG. 1 shows a transverse cross-sectional shape of the stator blade 9, and FIG. 2 diagrammatically shows this blade.

Figure 2:
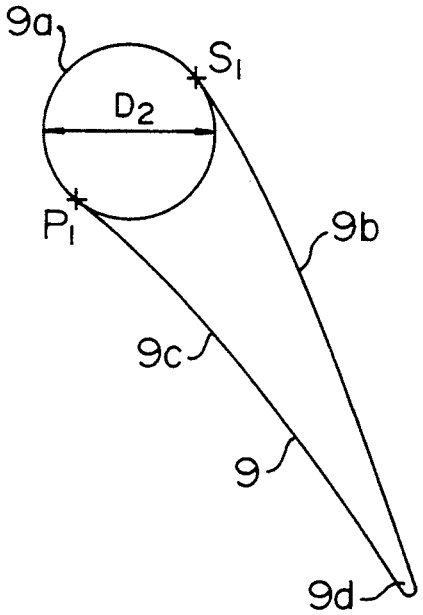
FIG. 2 is a diagrammatic illustration of a stationary blade according to a preferred embodiment of the present invention.

In these FIGS. 1 and 2, reference alpha-numeral 9*a* denotes a leading edge portion of the stator blade 9, reference alpha-numeral 9*b* a suction side of the blade 9, reference alpha-numeral 9*c* a pressure side of the blade 9, and reference alpha-numeral 9*d* a trailing edge portion of the blade 9. Reference alpha-numeral 9*f* denotes the above-mentioned air cooling chamber. This air cooling chamber 9*f* is divided by partition walls into three cavities, that is, air cooling chambers 9*f*$_1$, 9*f*$_2$ and 9*f*$_3$. In this case, in order to effect a good heat exchange, fins 9*h* are provided in the air cooling chambers 9*f*$_1$ and 9*f*$_2$ disposed at the leading side of the stator blade 9, and pin fins 9*g* are provided in the air cooling chamber 9*f*$_3$ disposed at the trailing side of the stator blade 9. The cooling construction may be of any other suitable type such as a convection cooling type.

In the stator blade 9 having the above-mentioned cooling construction, what is the most important is that the stator blade 9 has the following overall profile shape. More specifically, the cross-section of the leading edge portion of the stator blade 9 is in the shape of an arc having a diameter $D_2$, and the thickness of the stator blade 9 decreases progressively from the maximum thickness portion (between points $S_1$ and $P_1$) of the above arc toward the trailing edge. In this case, the maximum thickness portion of the arc is connected to the portion of the blade 9 progressively decreasing in thickness, and therefore strictly speaking, this maximum thickness portion between the points $S_1$ and $P_1$ slightly deviates from the real maximum thickness portion of diameter $D_2$.

Although the thickness of the blade 9 decreases progressively toward the trailing edge, the trailing edge portion of the blade 9 cannot be made too thin in view of a required mechanical strength thereof. Therefore, a small arc-shaped portion is provided at the trailing edge 9*d*. In other words, the profile (i.e., the cross-section) of the stator blade 9 is generally in the shape of a death fire or flame, that is, a shape defined by a rounded head and a convergent tail extending therefrom.

Figure 5:
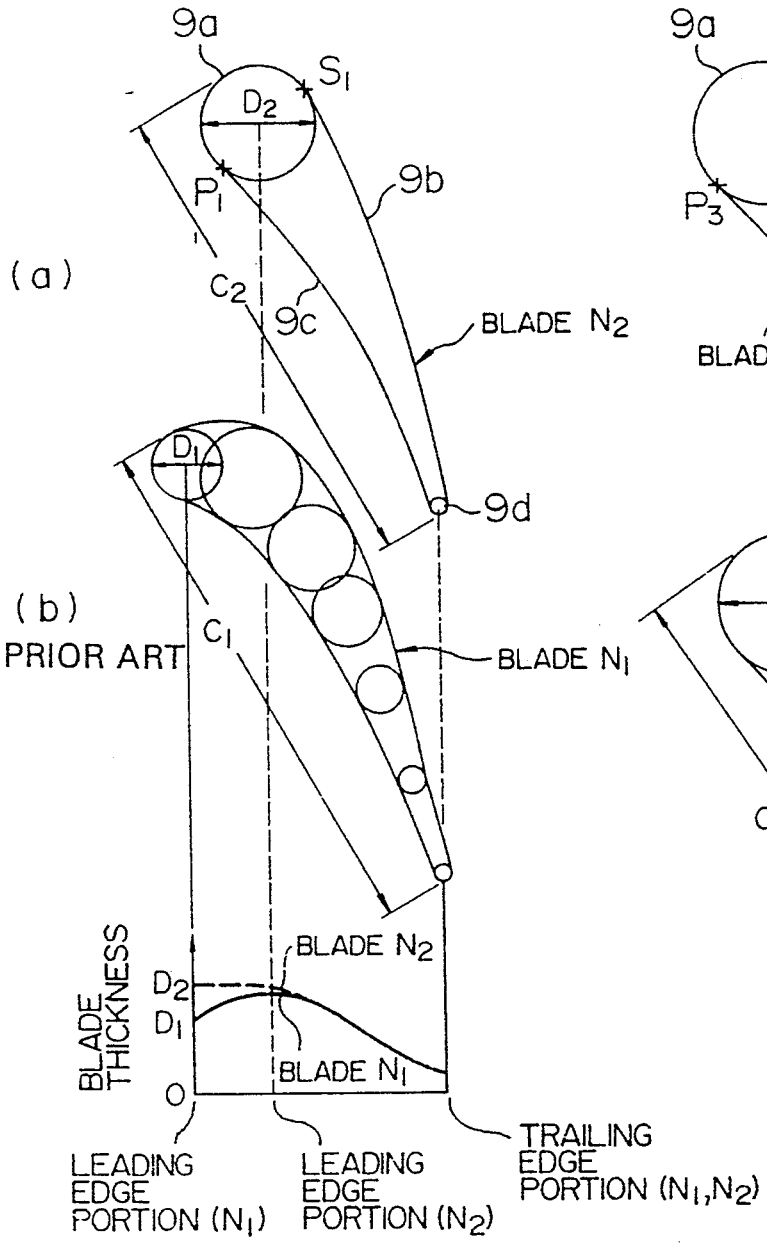
FIGS. 5(*a*) and 5(*b*) are diagrammatic illustrations of stationary blades.

The operation of the stator blade 9 of the above construction will now be described in comparison with that of a conventional blade. FIG. 5 diagrammatically show these blades, in (*a*) and (*b*) respectively, where $N_1$ represents the conventional blade and $N_2$ represents the blade of the present invention. The blade $N_1$ and the blade $N_2$ have the same performance, and the number of the blades $N_1$ mounted around a rotation shaft is the same as the number of the blades $N_2$ mounted around the rotation shaft, that is, the blades $N_1$ and the blades $N_2$ are arranged at the same pitch $PS_1$.

As regards the body size, the blade $N_1$ is greater in maximum chord length than the blade $N_2$ ($C_1 > C_2$). Values of this comparison are shown in Table 1.

TABLE 1

| Blade profile | Surface area ratio | Leading edge diameter ratio | Maximum blade thickness/ leading edge diameter | Cross-sectional area ratio | Chord length ratio |
|---|---|---|---|---|---|
| $N_1$ | 1.0 | 1.0 | 1.5 | 1.0 | 1.0 |
| $N_2$ | 0.91 | 1.6 | 1.0 | 0.89 | 0.89 |

Namely, the surface area of the blade $N_2$ having the shorter chord length is 91% of that of the blade $N_1$, the leading edge diameter of the blade $N_2$ is 1.6 times larger than that of the blade $N_1$, and the cross-sectional area of the blade $N_2$ is 89% of that of the blade $N_1$.

A total loss coefficient of these two blades, as well as the amount of flow of the air required to cool the blade metal to an allowable temperature of the material were determined, and results thereof are shown in Table 2.

TABLE 2

| Blade profile | Total loss coefficient ratio | Cooling air consumption amount ratio |
|---|---|---|
| $N_1$ | 1.0 | 1.0 |
| $N_2$ | 1.0 | 0.92 |

The blade $N_1$ and the blade $N_2$ had the same total loss coefficient value. Results of the experiment indicated that the amount of consumption of the cooling air for the blade $N_2$ was 8% smaller than that for the blade $N_1$. This is due to the fact that the surface area of the blade is reduced and the fact that the leading edge portion is circular-arc-shaped, and has a larger diameter.

Next, explanation will be made of the reason why the amount of consumption of the cooling air is reduced by increasing the leading edge diameter.

A heat transfer coefficient $\alpha_g$ of the blade leading edge on the gas side is expressed by the following equation (1):

$$\begin{aligned} \alpha_g &= k_1 \cdot R_e^{0.5} - P_r^{k2} \cdot \lambda/D \\ &= k_1 \cdot \left[\frac{VD}{\nu}\right]^{0.5} \cdot P_r^{k2} \cdot \lambda/D \end{aligned} \quad (1)$$

where $k_1$ and $k_2$ represent constants, Re represents the Reynolds number, Pr represents the Prandtl number, V represents a gas velocity, $\nu$ represents kinematic viscosity, $\lambda$ represents thermal diffusivity, and D represents the diameter of the circular arc at the leading edge.

If the condition of the gas side is the same, the following relationship (2) is obtained:

$$\alpha_g \propto D^{-0.5} \quad (2)$$

Therefore, the ratio of the heat transfer coefficient of the blade $N_2$ to that of the blade $N_1$ on the gas side is expressed by the following equation (3):

$$\begin{aligned} \frac{\alpha_g(N_2)}{\alpha_g(N_1)} &= (1.6)^{-0.5} \\ &\approx 0.79 \end{aligned} \quad (3)$$

Thus, the blade $N_2$ is 21% lower in heat transfer coefficient on the gas side than the conventional blade $N_1$, so that the amount of transfer of the heat from the hot gas to the blade $N_2$ is reduced, and therefore the leading edge portion of the blade $N_2$ can be cooled with a smaller amount of the cooling air.

When the amount of consumption of the cooling air is reduced, not only the cycle efficiency of the gas turbine is enhanced, but also a loss of mixing of the cooling air with the main stream gas is reduced, so that the performance of the gas turbine is significantly improved. Furthermore, since the cross-sectional area of the blade is reduced by 11%, there is another advantage that the cost for the material of the blade is reduced.

Another embodiment of the present invention will be now described with reference to FIG. 6.

Figure 6:
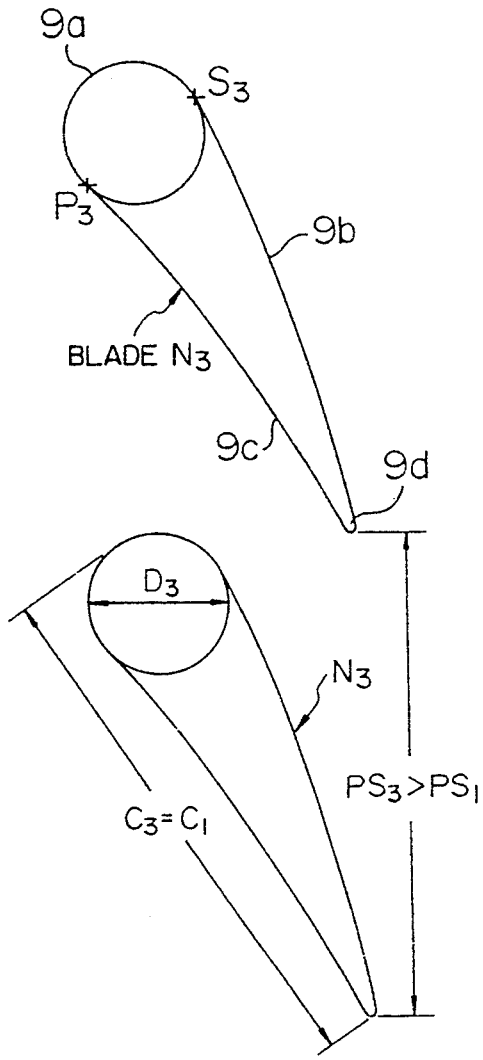
FIG. 6 is a diagrammatic illustration of stationary blades.

In FIG. 6, those portions designated respectively by the same reference numerals as those in FIG. 1 are the same or similar in construction and function as those of FIG. 1.

A blade $N_3$ has a leading edge diameter $D_3$ ($>D_2>D_1$), and a blade thickness thereof gradually decreases from the leading edge to the trailing edge, as in the blade $N_2$.

Although the maximum chord length $C_3$ of the blade $N_3$ is the same as that ($C_1$) of the conventional blade $N_1$, the pitch $PS_3$ is larger than that ($PS_1$) of the conventional blade. These profile shapes are shown in Table 3 for comparison purposes.

TABLE 3

| Blade profile | Surface area ratio | Leading edge diameter ratio | Maximum blade thickness/ leading edge diameter | Cross-sectional area ratio* | Number of blades ratio | Chord length ratio |
|---|---|---|---|---|---|---|
| $N_1$ | 1.0 | 1.0 | 1.5 | 1.0 | 1.0 | 1.0 |
| $N_3$ | 1.0 | 2.1 | 1.0 | 1.26 | 0.76 | 1.0 |

*value per blade

The blade $N_3$ and the blade $N_1$ have the same surface area; however, the number of the blades $N_3$ is 24% smaller than that of the blades $N_1$, and therefore the total surface area over the whole row of blades i.e. the whole blade-surface area, is reduced by 24%.

A total loss coefficient of the blades $N_3$ and $N_1$, as well as the amount of consumption of the cooling air were determined, and results thereof are shown in Table 4.

TABLE 4

| Blade profile | Total loss coefficient ratio | Cooling air consumption amount ratio |
|---|---|---|
| $N_1$ | 1.0 | 1.0 |
| $N_3$ | 0.77 | 0.80 |

The total loss coefficient of the blade $N_3$ is 77 % of that of the conventional blade $N_1$, and thus is reduced by 23%. This is due to the fact that although the trailing edge portion of the blade $N_3$ has the same thickness as that of the blade $N_1$, the pitch $PS_3$ of the blades $N_3$ is 1.31 times greater than the pitch $PS_1$ of the conventional blades because the number of the blades is reduced by 24%, thereby reducing the relative trailing edge thickness (trailing edge thickness/pitch), so that the trailing edge loss is reduced.

The amount of consumption of the cooling air is reduced by 20% due to the fact that the total blade surface area is reduced by 24% and the fact that the leading edge diameter $D_3$ is 2.1 times greater than that of the conventional blade $N_1$. Further, comparing the above-mentioned heat transfer coefficients on the gas side, the following equation (4) is derived:

$$\frac{\alpha_g(N_3)}{\alpha_g(N_1)} = (2.1)^{-0.5} \approx 0.69 \quad (4)$$

Thus, the heat transfer coefficient is reduced as much as 31%.

Thus, the blade $N_3$ is smaller not only in the amount of consumption of the cooling air but also in the total loss coefficient than the conventional blade $N_1$, and therefore the efficiency of the gas turbine is greatly enhanced.

Next, two endpoints $S_3$, $P_3$ at which the leading edge portion 9*a* is connected to the suction side and the pressure side respectively will now be described with reference to FIG. 7.

Figure 7:
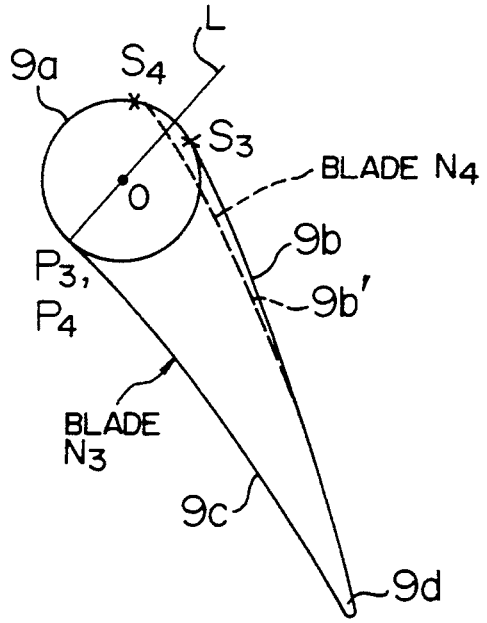
FIG. 7 is a diagrammatic illustration of a stationary blade.

In FIG. 7, the endpoint $S_3$ of the suction side of the blade $N_3$ is located downstream of a straight line L passing through the endpoint $P_3$ on the pressure side and the center O of the leading edge portion 9*a* (that is, the endpoint $S_3$ is located on the trailing edge side with respect to the above straight line L). This relationship is established also in the blade $N_2$ mentioned earlier. In a comparative blade $N_4$, a point $S_4$ of connection between a suction side 9*b*′ (designated by a dashed line) and the leading edge portion 9*a* is located upstream of the straight line L passing through the connection point $P_3$ on the pressure side 9*c* and the center O of the circular arc of the leading edge portion 9*a*. Aerodynamic performances of these two blades $N_3$, $N_4$ are shown in FIG. 8 for comparison purposes.

Figure 8:
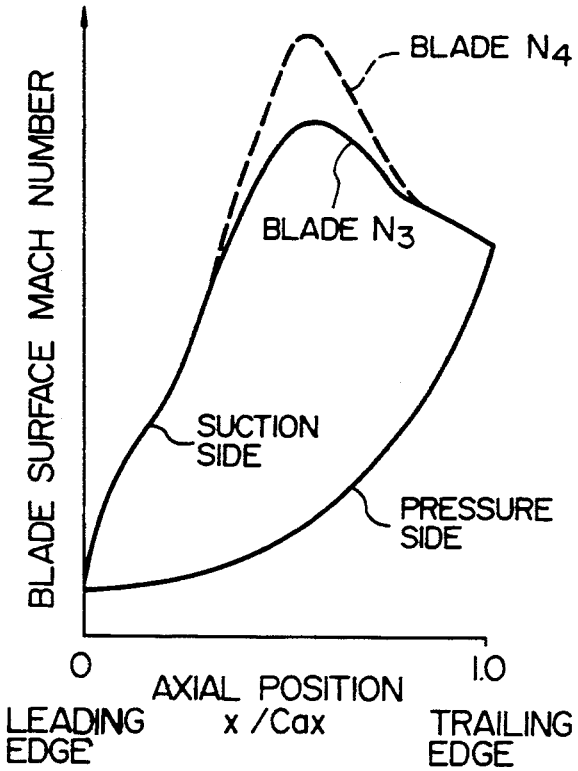
FIG. 8 is a diagram showing a surface Mach number distribution of blades of the present invention.

FIG. 8 shows a distribution of Mach number on the blade surface, and the abscissa axis represents the axial position of the blade ((the axial distance from the leading edge)/(axial chord length)).

The blade $N_4$ is greater in the maximum Mach number on the suction side than the blade $N_3$, the gas flow is more rapidly decelerated over a region from the maximum Mach number position to the trailing edge of the blade in the blade $N_4$ than the blade $N_3$, and separation of the flow was observed on the suction side in the blade $N_4$. As a result, the total loss coefficient of the blade $N_4$ was 1.9 times higher than that of the blade $N_3$. Thus, it has been found that the blade $N_4$ has a high aerodynamic loss because the radius of curvature is varied greatly at the point $S_4$ where the circular-arc-shaped leading edge portion is connected to the curved line defining the suction side 9*b*′. It has also been found from blade-to-blade flow analysis that such abrupt or rapid acceleration and deceleration of gas flow on the suction side can be prevented by locating the endpoint $S_3$ of the suction side at a position downstream of the straight line L passing through the endpoint $P_3$ of the pressure side and the center O of the circular arc of the leading edge portion 9*a*.

In the above embodiments, although the leading edge portion of the blades has the shape of an arc of a true circle, this arc does not always need to be part of a true circle, and similar effects can be achieved even if the leading edge portion has a shape defined, for example, by part of an ellipse, regardless of whether the line 37 L" corresponds to the minor axis or to the major axis of the ellipse.

As described above, in the present invention, the leading edge portion of the blade has an arc-shaped cross-section, and the maximum thickness portion of the blade is located within this arc. With this arrangement, the main stream gas flows along the endpoint portion of the arc which portion is smoothly connected to the pressure side of the blade and also along the endpoint portion of the arc which is smoothly connected to the suction side of the blade, and therefore an abrupt acceleration of the hot gas at the leading edge portion is suppressed to reduce the velocity of the hot gas on the blade surface. As a result, the heat transfer coefficient on the gas side is lowered, and therefore the amount of the cooling air required to be passed through the interior of the blade can be reduced.

Figure 9:
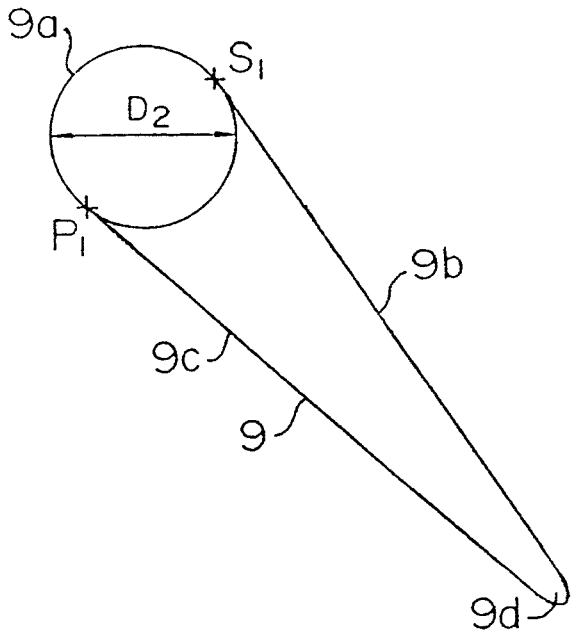
FIG. 9 is a diagram illustrating an embodiment wherein the blade has a linear profile between respective ends of the leading edge and trailing edge arcs.

Although the leading edge and trailing edge portions of the gas turbine blade have been described as having arc-shaped cross-sections, with opposite ends of the arc of the leading edge portion being connected by respective arcuate lines to opposite ends of the arc of the trailing edge portion, respectively, the respective ends of the arcs may be connected linearly, as shown in FIG. 9.

What is claimed is:

1. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion in the direction of a central portion of said blade, and then decreases progressively in the direction of the trailing edge portion; and said blade further has a cavity portion therein allowing a cooling medium to be passed therethrough to cool said blade from its inside;

wherein the leading edge portion of said blade has an arc-shaped cross-section having first and second endpoints, and wherein the first endpoint of the arc of the leading edge portion where the arc is connected with the suction side portion is located downstream of a virtual straight line extending, through a center of a circle defining the arc, from the second endpoint of the arc where the arc is connected with the pressure side portion.

2. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion in the direction of a central portion of said blade, and then decreases progressively in the direction of the trailing edge portion; and said blade further has a cavity portion therein allowing a cooling medium to be passed therethrough to cool said blade from its inside;

wherein the leading edge portion of said blade has an arc-shaped cross-section having first and second endpoints, and a maximum thickness portion of said blade is located within said arc; and wherein the first endpoint of the arc of the leading edge portion where the arc is connected with the suction side portion is located downstream of a virtual straight line extending, through a center of a circle defining the arc, from the second endpoint of the arc where the arc is connected with the pressure side portion.

3. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein the leading edge portion of said blade is arc-shaped, the arc defined between first and second endpoints of the leading edge portion;

a thickness of said blade increases progressively from said arc-shaped portion in the direction of a central portion of said blade to have a maximum thickness portion;

the thickness of said blade decreases progressively from said maximum thickness portion in the direction of the trailing edge portion of said blade;

said blade has a cavity portion therein allowing a cooling medium to be passed through said cavity portion to cool said blade from its inside;

wherein the first endpoint of the arc of the leading edge portion where the arc is connected with the suction side portion is located downstream of a virtual straight line extending, through a center of a circle defining the arc, from the second endpoint of the arc where the arc is connected with the pressure side portion; and wherein a diameter of said arc at the leading edge portion of said blade is equal to the maximum thickness of said blade.

4. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion thereof in the direction of a central portion of said blade, and then decreases progressively in the direction of the trailing edge portion of said blade; and said blade further has a cavity portion therein allowing a cooling medium to be passed therethrough to cool said blade from its inside;

wherein the leading edge portion of said blade has an arc-shaped cross-section, and the thickness of said blade decreases progressively from opposite ends of said arc in the direction of the trailing edge portion of said blade; and wherein a first endpoint of the arc of the leading edge portion where the arc is connected with the suction side portion is located downstream of a virtual straight line extending, through a center of a circle defining the arc, from a second endpoint of the arc where the arc is connected with the pressure side portion.

5. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion thereof in the direction of a central portion of said blade, and then decreases progressively in the direction of an end of the trailing edge portion of said blade; and said blade further has a cavity portion therein allowing a cooling medium to be passed therethrough to cool said blade from its inside;

wherein each of the leading edge portion and the trailing edge portion has an arc-shaped cross-section, and opposite ends of said arc of the leading edge portion are connected linearly to opposite ends of said arc of the trailing edge portion, respectively; and wherein a first endpoint of the arc of the leading edge portion where the arc is connected with the suction side portion is located downstream of a virtual straight line extending, through a center of a circle defining the arc, from a second endpoint of the arc where the arc is connected with the pressure side portion.

6. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion thereof in the direction of a central portion of said blade, and then decreases progressively in the direction of the trailing edge portion of said blade; and said blade further has a cavity portion therein allowing a cooling medium to be passed therethrough to cool said blade from its inside;

wherein each of the leading edge portion and the trailing edge portion has an arc-shaped cross-section, and opposite ends of said arc of the leading edge portion are connected by respective arcuate lines to opposite ends of said arc of the trailing edge portion, respectively; and wherein a first endpoint of the arc of the leading edge portion where the arc is connected with the suction side portion is located downstream of a virtual straight line extending, through a center of a circle defining the arc, from a second endpoint of the arc where the arc is connected with the pressure side portion.

7. A blade for a gas turbine comprising:

an arc-shaped leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion thereof in the direction of a central portion of said blade, and then decreases progressively in the direction of an end of the trailing edge portion of said blade; and said blade further has a cavity portion therein allowing a cooling medium to be passed therethrough to cool said blade from its inside;

wherein a transverse cross-section of said blade is of a shape defined by a rounded head and a convergent tail extending therefrom; and wherein a first endpoint of the arc of the leading edge portion where the arc is connected with the suction side portion is located downstream of a virtual straight line extending, through a center of a circle defining the arc, from a second endpoint of the arc where the arc is connected with the pressure side portion.

8. A blade for a gas turbine comprising:

a leading edge portion, a suction side portion, a pressure side portion and a trailing edge portion, and having a blade shape defined by outer surfaces of the leading edge, suction side, pressure side and trailing edge portions;

wherein a thickness of said blade first increases progressively from an end of the leading edge portion thereof in the direction of a central portion of said blade, and then decreases progressively in the direction of an end of the trailing edge portion of said blade; and said blade further has a cavity portion therein allowing a cooling medium to be passed therethrough to cool said blade from its inside;

wherein the leading edge portion of said blade has an arc-shaped cross-section, and the thickness of said blade decreases progressively in the direction of the trailing edge portion thereof from portions of a surface of said blade corresponding to diametrically opposite portions of an imaginary circle defining said arc; and wherein a first endpoint of the arc of the leading edge portion where the arc is connected with the suction side portion is located downstream of a virtual straight line extending, through a center of the circle defining the arc, from a second endpoint of the arc where the arc is connected with the pressure side portion.

9. A gas turbine including blades each adapted to be cooled from the inside thereof by compressed air from a compressor connected to the turbine;

each blade including a leading edge portion, a suction side portion, a pressure side portion and a trailing edge portion, and having a blade shape defined by outer surfaces of the leading edge, suction side, pressure side and trailing edge portions wherein the leading edge portion of said blade has an arc-shaped cross-section, and a thickness of said blade decreases progressively from a maximum thickness portion on said arc in the direction of the trailing edge portion of said blade; and wherein a first endpoint of the arc of the leading edge portion where the arc is connected with the suction side portion is located downstream of a virtual straight line extending, through a center of a circle defining the arc, from a second endpoint of the arc where the arc is connected with the pressure side portion.

* * * * *